US009510437B1

(12) United States Patent
Squires et al.

(10) Patent No.: US 9,510,437 B1
(45) Date of Patent: Nov. 29, 2016

(54) SYSTEM AND METHOD FOR CREATING A PREDETERMINED MAGNETIC POTENTIAL

(71) Applicants: Matthew B. Squires, Sandia Park, NM (US); James A. Stickney, Wakefield, MA (US); Brian Kasch, Albuquerque, NM (US)

(72) Inventors: Matthew B. Squires, Sandia Park, NM (US); James A. Stickney, Wakefield, MA (US); Brian Kasch, Albuquerque, NM (US)

(73) Assignee: THE UNITED STATES OF AMERICA AS REPRESENTED BY THE SECRETARY OF THE AIR FORCE, Washington, DC (US)

( * ) Notice: Subject to any disclaimer, the term of this patent is extended or adjusted under 35 U.S.C. 154(b) by 0 days.

(21) Appl. No.: 14/692,697

(22) Filed: Apr. 21, 2015

(51) Int. Cl.
*H05H 3/02* (2006.01)
*H05H 3/04* (2006.01)

(52) U.S. Cl.
CPC ..... *H05H 3/04* (2013.01)

(58) Field of Classification Search
USPC ..... 250/251
See application file for complete search history.

(56) References Cited

U.S. PATENT DOCUMENTS

2009/0212204 A1* 8/2009 McBride ..... H05H 3/02 250/251

OTHER PUBLICATIONS

Reichel, J. et al., Atomic Micromanipulation With Magnetic Surface Traps, Physics Rev. Lett., Oct. 25, 1999, vol. 83, p. 3398.
Weinstein, J.D. et al., Microscopic Magnetic Traps for Neutral Atoms, Physical Rev. A, Nov. 1, 1995, vol. 52, p. 4004.

* cited by examiner

*Primary Examiner* — Nicole Ippolito
*Assistant Examiner* — Hanway Chang
(74) *Attorney, Agent, or Firm* — James M. Skorich

(57) ABSTRACT

A method and system for algebraically generating precise magnetic potentials along the axis of a cold atom waveguide. Sets of paired conductors may provide control over the even and odd contributions of the polynomial potential along one axis of the trap. Various field configurations can be realized, including double wells, triple wells, and filtered harmonic traps with suppression of higher order terms. An example of a system disclosed herein may be a suitable dual-layer atom chip, with modest experimental requirements, that allows independent tuning of terms up to fourth order.

20 Claims, 11 Drawing Sheets

SYSTEM AND METHOD FOR CREATING A PREDETERMINED MAGNETIC POTENTIAL

STATEMENT OF GOVERNMENT INTEREST

The conditions under which this invention was made are such as to entitle the Government of the United States under paragraph 1(a) of Executive Order 10096, as represented by the Secretary of the Air Force, to the entire right, title and interest therein, including foreign rights.

FIELD OF THE DISCLOSURE

The present invention relates to a chip device that employs precise potentials to control a magnetic field.

BACKGROUND

Wires fabricated on thermally conductive substrates for trapping atoms are often called "atom chips." Atom chips encompass chips that are used to generate magnetic, electrical and/or direct optical fields to manipulate cold atoms or molecules. Magnetic fields gradients can be used to create a force on atoms. That force can be used to turn magnetic fields into a trap, a lens, a moving wave, etc. for neutral atoms. The atom chip may contain additional features, such as electronic components, lenses, micromechanics, etc. Additionally, the atom chip can provide electrical feedthroughs from a vacuum cell exterior to its interior.

SUMMARY

Aspects of the embodiments disclosed herein include: an atom chip device comprising: a plurality of wires configured to control a potential in a first direction;
a waveguide configured to control the potential in a second direction; and wherein the plurality wires are spaced a predetermined distance apart so that by adjusting currents in the plurality of wires the magnitude and direction of the potential can be tuned.

Further aspects of the embodiments disclosed herein include: a method of controlling atoms using an atom chip comprising: adjusting the currents in a plurality of wire pairs which are i) substantially perpendicular to a waveguide; and ii) spaced a predetermined distance apart according to a polynomial model so as to tune a magnitude and direction of a potential.

DETAILED DESCRIPTION

Figure 1A:
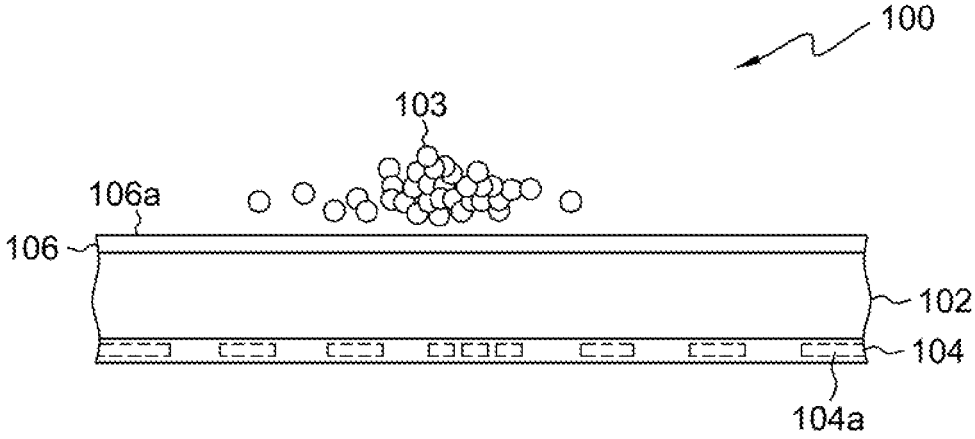
FIG. 1A is a schematic side view of a multilayer atom chip.

Magnetic fields have been used to confine atoms in a variety of traps. The exact magnetic field can be modeled but the precise control over these traps has often been lacking. The atoms can still be trapped but higher order terms can cause aberrations. This is similar to imaging optics. Most spherically shaped glass will act as a lens but high quality optics use special shapes to cancel errors that come from imperfections at the edge of the lens. These lenses are often called aspheric lens because the edge has been modified such that the shape of the lens deviates from a perfect sphere. The same is true for magnetic fields; nearly any magnetic trap can control and move the atoms, but precision control means having a method to adjust the shape of the magnetic field.

Experiments with cold atoms often rely on carefully designed magnetic fields to realize tailored magnetic potentials. Multilayer structures with complex wire patterns can be produced lithographically or by etching direct bonded copper (DBC) on an aluminum nitride (AlN) substrate. Dynamic adjustment of the currents through the patterned wires enables a broad range of possible magnetic trapping parameters, which can further be expanded with the addition of radio frequency and microwave fields. The extensive configurability and compact size of atom chips has made them a cornerstone of emerging atomic sensor technologies.

In many experiments, an atom cloud is sufficiently confined in two directions that its dynamics can be described by a one-dimensional (1D) equation of motion. While precise control over this effective 1D potential is very important, however, few structures take full advantage of the configurability afforded by atom chips. In at least one of the embodiments disclosed herein is a system and method for atom chips that produce tunable 1D potentials using a static magnetic field. Both even and odd contributions are accessible, enabling polynomial potentials to be realized. In practice, predetermined tunability requires more current in the chip wires leading to higher power dissipation. Larger wire spacings require higher power dissipation in order to have an effect near the center of the magnetic trap. Placing wire pairs at the zeros of higher order terms has led to larger wire spacing for the outermost wire pair. Reducing the wire spacing will reduce the total power requirements at the expense of mathematically precise cancellation of higher order contributions. The tradeoff between power dissipation and small but non-zero higher order contribution is embodied in the low power configuration where the spacing of the outermost wire pair is reduced. The atom chip disclosed herein is capable of controlling the 1D potential including both the optimal control and reduced power wire configurations.

In the discussion below, first, an idealized atom chip and its corresponding 1D polynomial potential model will be presented and the tunability of both even and odd terms examined and, secondly, an exemplary atom chip will be described and wire currents will be solved for using either the optimally placed wire pair or the low power configuration.

Magnetic Field Control in 1D

Figure 1B:
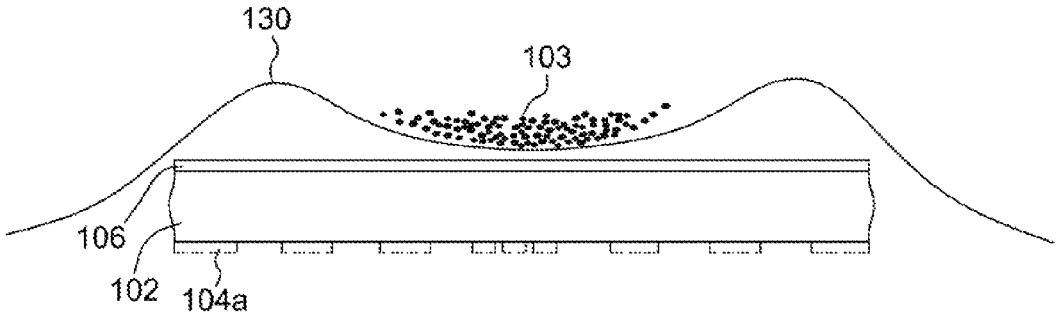
FIG. 1B is a schematic side view of the atom chip of FIG. 1A in operation showing the potential created by the tuning wires 104*a*.
Figure 1C:
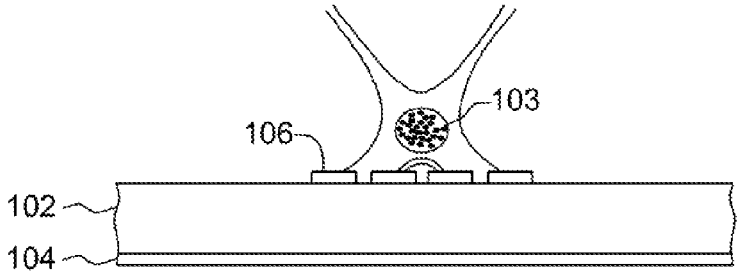
FIG. 1C is a schematic side view of the atom chip if FIG. 1A in operation showing the potential created by the waveguide 106.
Figure 2A:
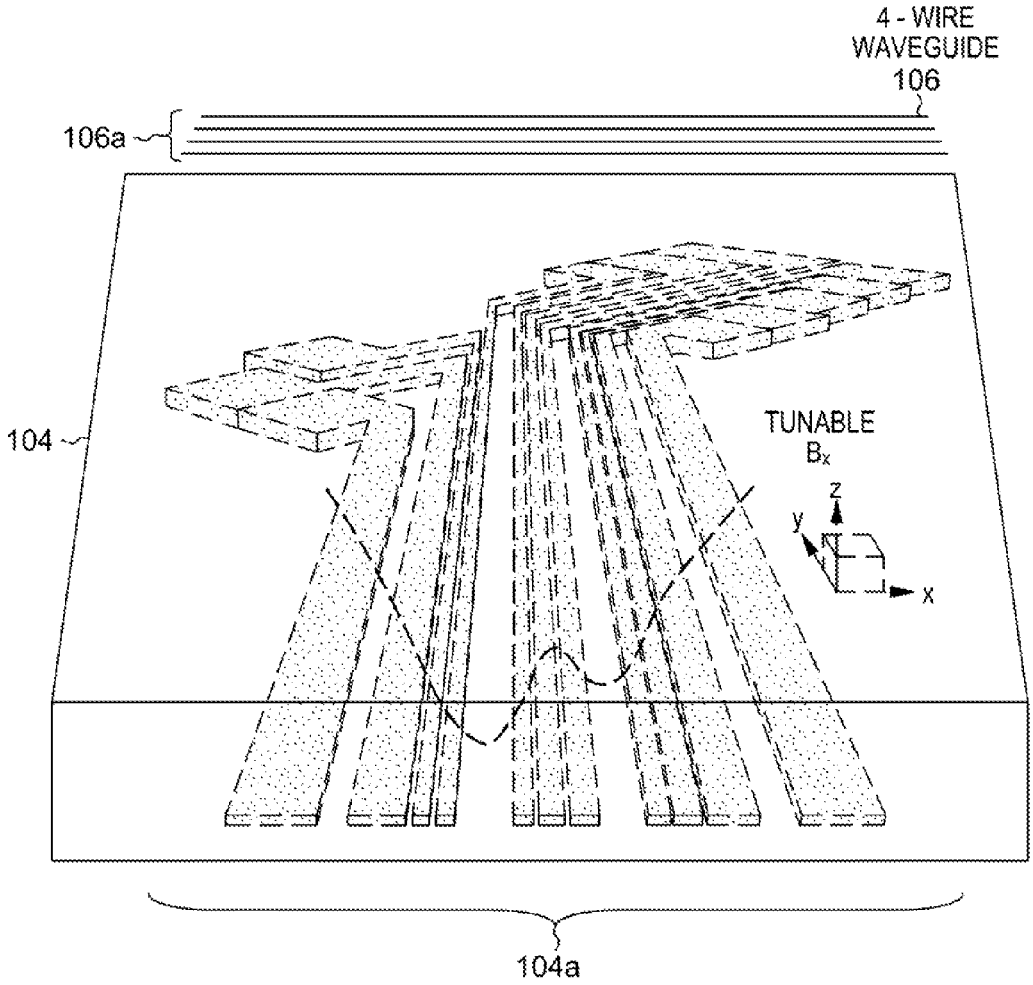
FIG. 2A is a schematic top view of the atom chip of FIG. 1A showing the layer 104 containing tuning wires 104*a*.
Figure 2B:
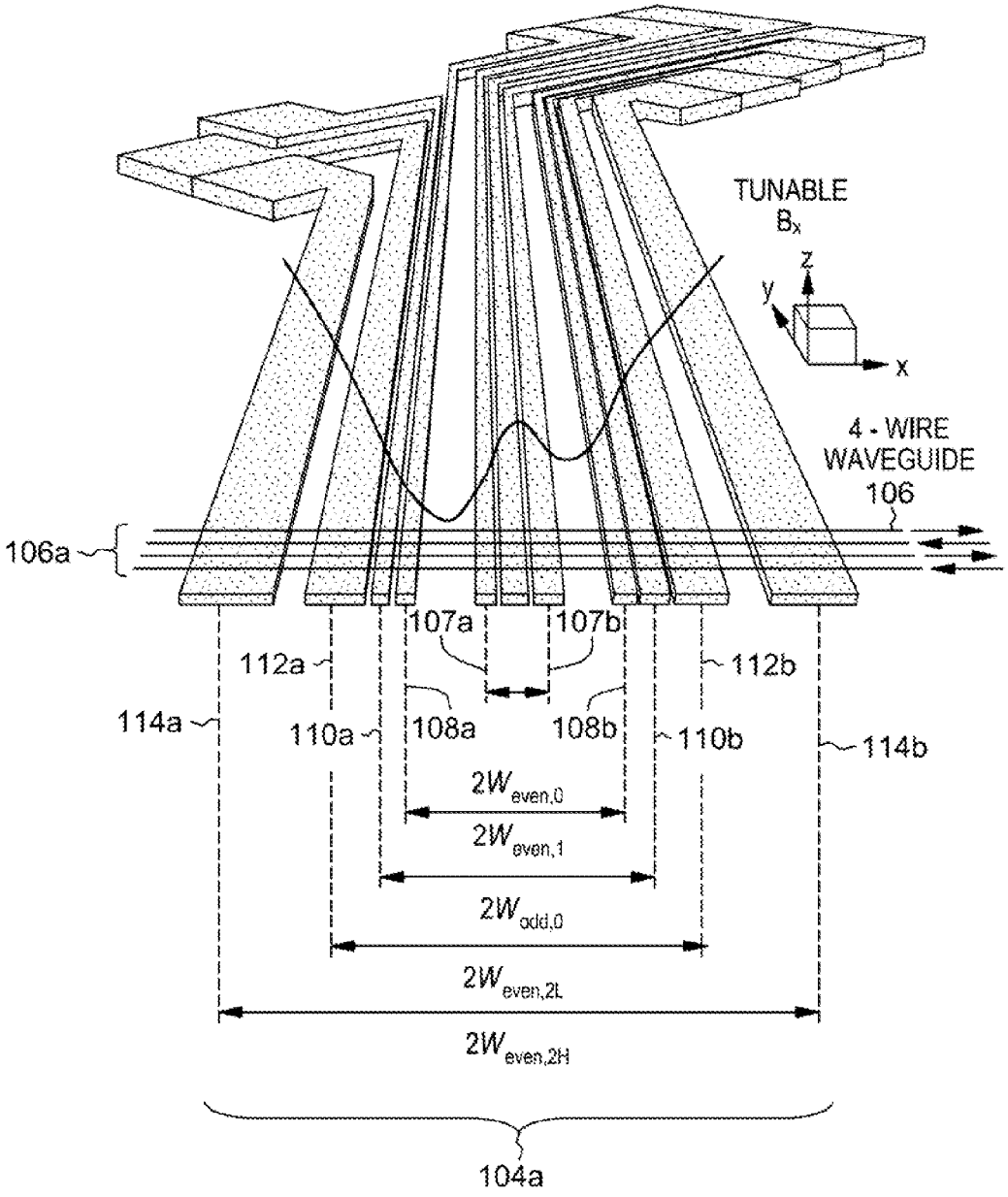
FIG. 2B is a schematic view of the atom chip of Figures IA showing the tuning wires 104*a* arranged to obtain tunable control over a magnetic field along the waveguide 106.
Figure 2C:
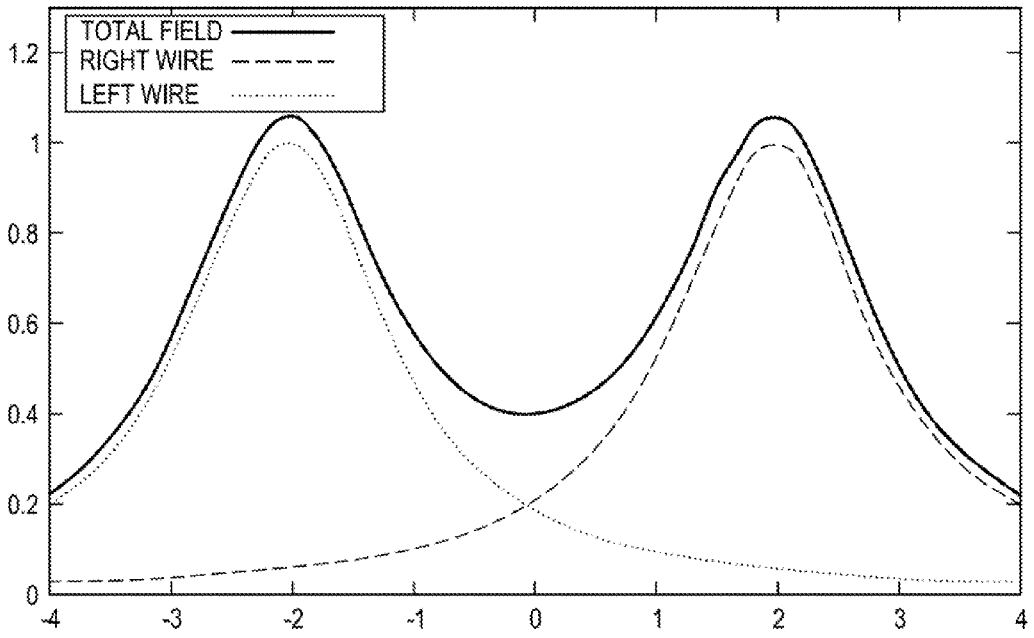
FIG. 2C is an example of a field created by combining a symmetrical wire trap pair.
Figure 2D:
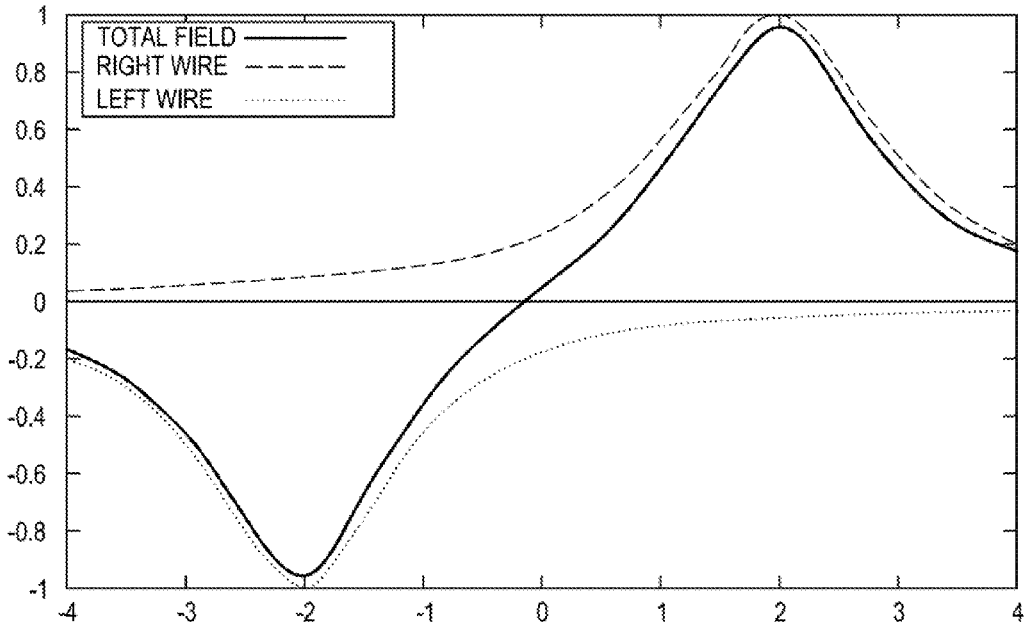
FIG. 2D is an example of an asymmetrical field created by combining odd wire pairs.
Figure 2E:
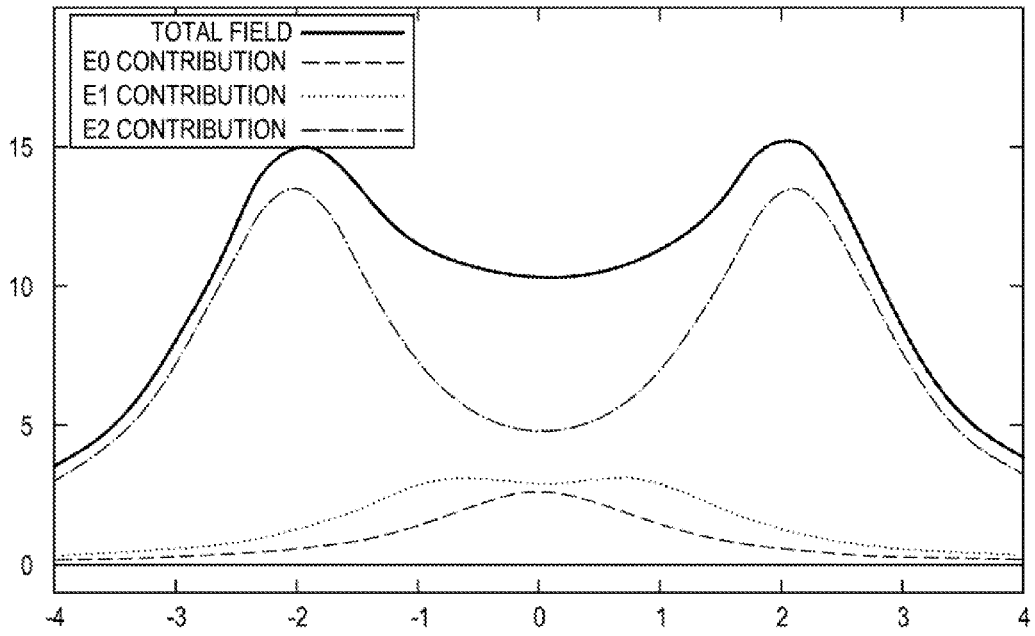
FIG. 2E illustrates how the total field forms a harmonic trap.
Figure 2F:
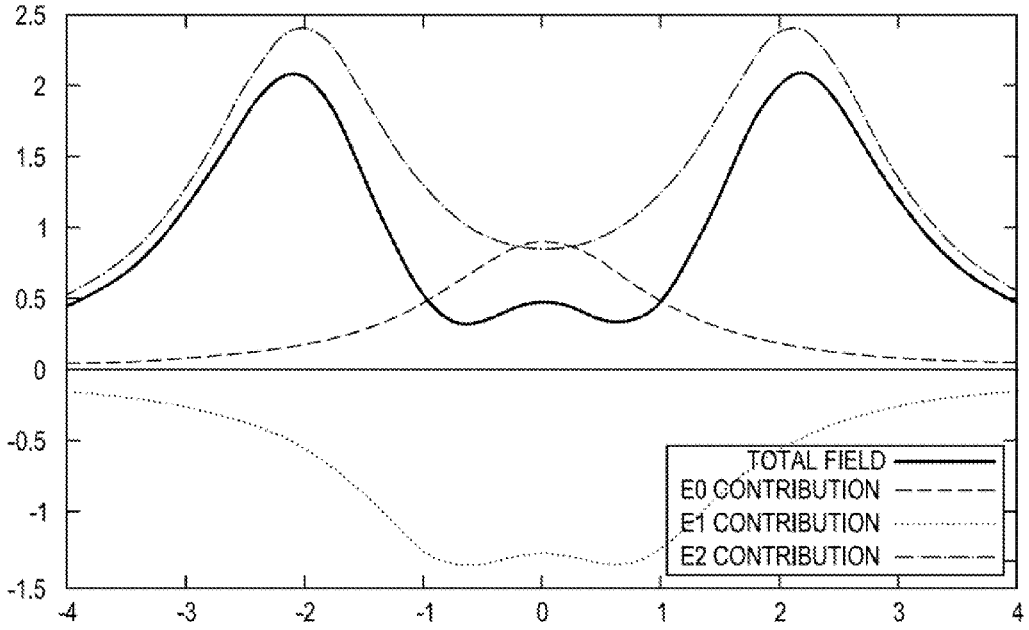
FIG. 2F illustrates how the total field forms a double well.

FIG. 1A is a schematic side view of an atom chip (or integrated circuit) device 100 operating in a vacuum chamber (e.g., ultra high vacuum chamber) (not shown). The atom chip device 100 includes a chip substrate 102 upon which two layers are mounted. A first layer 104 on the bottom of the substrate 102 includes one wire or a plurality of wires 104*a* patterned onto the atom chip device 100. The wires 104*a* provide an adjustable uniform external magnetic field 130 to control atoms 103 as shown in FIG. 1B. A second layer 106 which is closest to the atoms 103 may be used to create a magnetic waveguide and potential 140 as shown in FIG. 1C. A top schematic view of the waveguide 106 on atom chip 100 is illustrated in FIG. 2A. FIG. 2B shows the set of four horizontal black wires 106*a* making up the waveguide 106 which perpendicularly (or substantially perpendicularly) cross wires 104*a* to tightly confine the atoms 103 in two directions. Wires 104*a* may be organized into wire pairs (even and odd) as shown by the dotted lines in FIG. 2B. Even wire pairs create a potential that is symmetric about the center of the wire pattern. The current of the wires 104*a* is in the same direction so that when their magnetic field 130 combined with the magnetic field 140 of waveguide 106 add together they make a symmetric magnetic field. An example of a field created by combining a symmetrical wire trap pair is shown in FIG. 2C. Odd wire pairs create a potential 140 that is asymmetric about the center of the wire pattern. Arrows in FIG. 2B show the current in wires 106*a* running in opposite direction. By running current in the wires 106*a* in opposite directions the magnetic field 130 when combined with the magnetic field 140 of the waveguide creates an asymmetric field, that goes to zero at the center which can be approximated as a linear magnetic field. FIG. 2D shows au asymmetrical field created by combining odd wire pairs. FIGS. 2E and 2F illustrate how the total field is a sum of the contributions from multiple wire pairs. FIG. 2E shows a harmonic trap and FIG. 2F a double well.

The term "parallel" will be used in this disclosure to indicate the plurality of wire pairs are substantially in parallel for at least a portion of their length and, particular, are in parallel when crossed by the waveguide 106. Wires 104*a* are made up of wires pairs (or sets): 107*a* and 107*b*; 108*a* and 108*b*; 110*a* and 110*b*; 112*a* and 112*b*; and 114*a* and 114*b*. The wires 104*a* can control the axial magnetic field (Bx) along, the waveguide and the corresponding one-dimensional (1 D) potential. These even and odd wire pairs 104*a* are spaced by $2W_{p,m}$ and they allow for control over even and odd contributions to the 1D potential. Therefore, described herein will be a method and system for algebraically generating precise magnetic potentials along an axis of a cold atom waveguide. Sets of paired conductors may provide control over the even and odd contributions of a polynomial potential along one axis of the trap. As discussed, various field configurations can be realized, including double wells, triple wells, and filtered harmonic traps with suppression of higher order terms.

Waveguide Plus Axial Magnetic Field

A magnetic waveguide is a field configuration wherein the magnetic field vanishes along an axis. Near the zero: the field points perpendicular to the guide and can be described by a single parameter, G, which is the magnetic field gradient of the waveguide. For example, the magnetic field (B) for waveguide 106 that points in the x-direction can be written as:

$$B_{radial}=G(\hat{e}_y y-\hat{e}_z z).$$

The 1D potential will, be created using a magnetic field that is produced by the current in the wires 104 that run parallel to the y-axis (perpendicular to the waveguide axis). This magnetic field will provide confinement along the x-axis and will be assumed to be of the following, form:

$$B_{axial}=B_x(x,z)\hat{e}_x+B_z(x,z)\hat{e}_z.$$

The z-independence in the above equation causes two small shifts to the potential. First, it causes a change in the gradient in the z-direction, which can be neglected when:

$$G \gg \frac{\partial B_z}{\partial z}$$

Next, it causes a displacement in the z-direction, which can be neglected when:

$$G^2\sigma_x \gg \frac{\partial B_x^2}{\partial z}$$

where $\sigma_x$ is the size of the cloud in the x-direction. When these inequalities are satisfied, the $B_{axial}$ equation reduces to:

$$B_{axial}=B_x^T(x)\hat{e}_x+B_z(x)\hat{e}_z.$$

The x-component of the magnetic field creates the potential along the waveguide 106 and is the field that it is desirable to control. The z-component of this field causes deformations to the waveguide 106. The constant term, $B_z^{(0)}=B_R D^{(0)}$, causes a shift in the location of the guide by $B_z^{(0)}/G$ along the y-axis, which can be corrected using a uniform bias field in the z-direction. It will be assumed the appropriate zeroing bias is applied. The second term causes a rotation of the waveguide about z in the x-y plane. The waveguide is rotated by the angle, $\theta \approx B^{(1)}/G$. When using optical pulses to manipulate the state of the trapped atoms, this rotation angle becomes important. Typically, this angle will be set to zero and neglected. However, including nonzero rotations is straightforward.

With $B_z$ set to zero, the field along the waveguide 106 axis can be separated into two parts: a non-zero "bottom field" $B_x(0)$, which prevents spin-flip losses and is necessary for the potential to be separable, and $B_x(x)$, the part of the axial field that depends on the x-coordinate as follows:

$$B_{axial}=B_x^T(x)=B_x(0)+B_x(x).$$

The potential that the atoms experience is obtained from the radial and axial components as follows:

$$V=\mu\sqrt{(B_x(0)+B_x(x))^2+G^2 r_\perp^2},$$

where $\mu=\mu_B g_F m_F$ is the magnetic moment of the atomic state that is trapped, $\mu_B$ is the Bohr magneton, $g_F$ the Lande g-factor, $m_F$ is the magnetic quantum number, and $$r_\perp=\sqrt{y^2+z^2}$$

is the radial coordinate.

Assuming that $B_x(0)>>B_x(x)$ and expanding the equation above yields:

$$V=\mu\left(|B_x(0)+B_x(x)|+\frac{1}{2}\frac{G^2}{|B_x(0)|}r_\perp^2-\frac{1}{2}\frac{G^2}{|B_x(0)|B_x(0)}B_x(x)r_\perp^2\right).$$

The last term in this equation is clearly not separable, i.e., it cannot be written in the form:

$$V=V_{axial}(x)+V_{radial}(r_\perp).$$

However, the potential may be regarded as separable in the limit where:

$$B_x(0)^2>>G^2\sigma_\perp^2,$$

where $\sigma_\perp$ is the characteristic size of the atomic cloud in the radial direction. Therefore, the potential along the waveguide 106 (i.e., the 1D potential along x) can be written in the form:

$$V=\mu|B_x^T(x)|+\frac{1}{2}m\omega_\perp^2 r_\perp^2,$$

where $\mu$ is the magnetic moment of the trapped atomic state, $B_x^T(x)$ is the tunable magnetic field in the x-direction, $\omega_\perp$ is trapping frequency in the radial direction, and m is the atomic mass. This equation is valid when:

$$\mu|B_x(0)|>>m\omega_\perp^2\sigma_\perp^2,$$

where $\sigma_\perp$ was defined above.

The tunable field $B_x^T(x)$ will be created using wires 104*a* running perpendicular to the waveguide 106 as shown in FIG. 2. The wires 104*a* may be referred to as pinch wires, since they act much like the pinch coils in an Ioffe trap. The tunable field can be expanded into the following series:

$$B_x^T(x)=B_x^*+B_R\left[C^{(0)}+C^{(1)}\left(\frac{x}{H}\right)+C^{(2)}\left(\frac{x}{H}\right)^2+C^{(3)}\left(\frac{x}{H}\right)^3+C^{(4)}\left(\frac{x}{H}\right)^4+\ldots\right]$$

where H is the distance of the trap from the plane of the wires, $B_x^*$ is the magnitude of the externally applied uniform bias field in the x-direction, and $B_R$ is the overall potential scaling given by the following equation:

$$B_R=\frac{\mu_0 I_R}{2\pi H},$$

where $I_R$ is the reference current. In general, each of the pinch wires 104*a* make contributions to all of the expansion coefficients $C^{(n)}$. However, half of these contributions can be eliminated by using a pair of pinch wires in which each carries an equal magnitude of current. If the currents point in the same (opposite) direction, only even (odd) coefficients are generated from the pair. Thus, the set of wire pairs that affects the even terms leaves the odd terms unaltered and vice-versa. Furthermore, by adjusting the relative currents in several pinch wire pairs 104*a*, the coefficients $C^{(n)}$ become independently tunable dimensionless parameters. As a result, a single chip layout can be used create a wide variety of 1D potentials.

Now will be described how predetermined values of certain coefficients $C^{(n)}$ can be generated from a particular wire configuration. Let $n\geq 0$ be the order of the coefficient of interest. As previously disclosed, the parity of n determines whether currents corresponding to the even or odd set of wire pairs contribute to $C^{(n)}$. This parity label, p, may be defined as:

$$p(n)=\begin{cases}\text{even} & :\text{if } n \text{ is even}\\ \text{odd} & :\text{if } n \text{ is odd}\end{cases}$$

Let Mp(n) be the number of wire pairs of parity p(n). When in is even (odd), Mp(n) represents the number of even (odd) wire pairs with current running in the same (opposite) direction.

$$M_{p(n)}=\begin{cases}\#\text{ of even wire pairs} & :\text{if } n \text{ is even}\\ \#\text{ of odd wire pairs} & :\text{if } n \text{ is odd}\end{cases}$$

To find the coefficients in this equation, the following relation may be used:

$$C^{(n)}=\sum_{m=0}^{M_p-1} i_{p,m}c^{(n)}(w_{p,m}).$$

Here $i_{p,m}=I_{p,m}/I_R$ is the relative current in the m-th wire pair, and $c^{(n)}$ is a dimensionless parameter that is a function of (half) the wire pair separation, $w_{p,m}=W_{p,m}/H$. The value of the bottom field can now be written as:

$$B_x(0)=B_x^*+B_R\sum_{m=0}^{M_{even}-1} i_{even,m}c^{(0)}(w_{even,m}).$$

wherein it may be noted that the odd wires make no contribution. The tunable field is a sum of the bottom field with terms that depend on the x-coordinate, $$_x(x)=B_x(0)+B_x(x)$$

As described in Appendix B of the paper by Stickney, James et al., "Tunable Axial Potentials For Atom Chip Waveguides", dated Apr. 30, 2014, which is hereby incorporated by reference in its entirety, it is demonstrated that the parameters $c^{(n)}$ are given by the relation:

$$c^{(n)}(w)=\frac{2}{(1+w^2)^{n+1}}\sum_{r=0}^{n}(-1)^{(n+r)/2}\binom{n+1}{r}w^r\phi_{n+r},$$

for any n, where $\phi_a=(1+(-1)^a)/2$ is a parity function of the integer argument a that is one if a is even and zero if a is odd.

The magnetic field of the wire pairs also consists of a component in the z-direction. This field can be expanded as $$B_z(x) = B_z^* + B_R\left(D^{(0)} + D^{(1)}\frac{x}{H} + \ldots\right).$$

The opposite parity condition in the z-direction means that the dimensionless parameters, $D^{(n)}$, are due to wires of parity p(n+1), of which there are Mp(n+1). Therefore:

$$D^{(n)} = \sum_{m=0}^{M_{p(n+1)}-1} i_{p(n+1),m} d^{(n)}(w_{p(n+1),m}),$$

where $d^{(n)}$ are dimensionless parameters that depend only on the spacing of the wires. The parameter $D^{(0)}$ causes a displacement of the waveguide in the z-direction. However, this constant field can be corrected for with the addition of a uniform bias field $B_z$*. It shall be assumed that the correct bias field is applied.

Non-zero values of $D^{(1)}$ cause a rotation of the waveguide. Usually one wants to work in the region where this rotation is set to zero. However there are situations where changing this rotation angle will be useful, such as the alignment of an atom cloud 103 with a standing wave laser field. Extensions to non-zero rotations are straightforward, but will not be used in the following.

A general expression for $d^{(n)}$ may be found, however, there is only interest in the lowest two powers which can be expressed as:

$$d^0(w_{odd,m}) = 2\frac{w_{odd,m}}{w_{odd,m}^2 + 1},$$

and:

$$d^{(1)}(w_{even,m}) = -2\frac{(w_{even,m} - 1)(w_{even,m} + 1)}{(w_{even,m}^2 + 1)^2}.$$

The currents in a set of $M_{even}$ wire pairs can be used to control, usually the lowest $M_{even}-1$ terms from the equation for $C^{(n)}$, plus the parameter $D^{(1)}$, from the equation for $D^{(n)}$ above. For a given set of wire spacings, $\{w_{even}\}$, the currents can be found by inverting the equations for $C^{(n)}$ and $D^{(n)}$. Once the currents have been found, the contributions to the potential from the uncontrolled parameters can be calculated.

Similarly, the currents in a set of $M_{odd}$ wire pairs can be used to control $M_{odd}$ terms from equation for $C^{(n)}$. Once the wire spacing's $\{w_{odd}\}$ has been determined, the currents are found by inverting the equations for $C^{(n)}$ and $D^{(n)}$. An applied bias field of $B_z^*=-B_R D^{(0)}$ is required to cancel the $D^{(0)}$ that arises from the odd wire pairs. The value can be calculated from the currents and using the equation for $D^{(n)}$ and $d^0(w_{odd,m})$ above.

Figure 3:
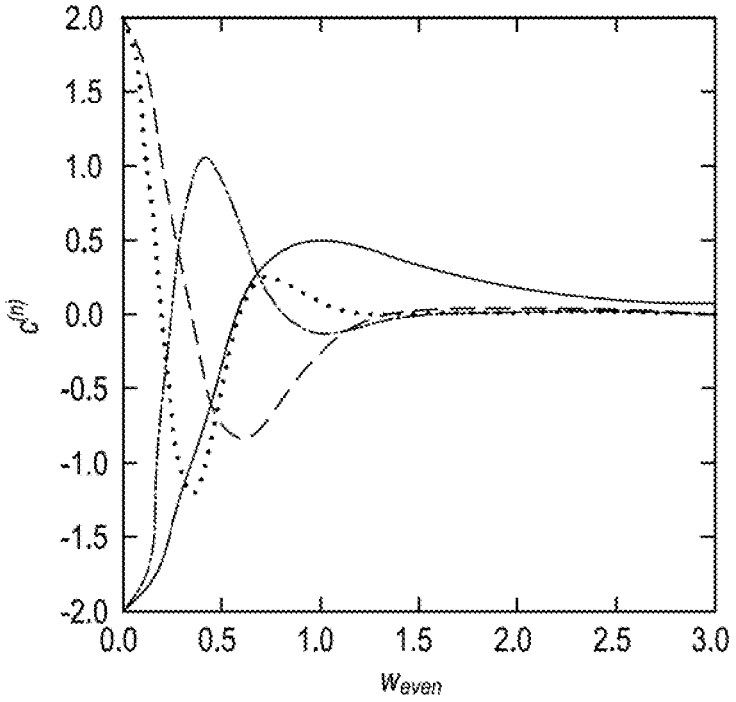
FIG. 3 shows the relative strength of each of the coefficients (C's) of a polynomial equation for a tunable magnetic field as a function of the waveguide wire spacing.

FIG. 3 shows the first few even values of the coefficients $c^{(n)}$ (or parameters) as a function of wire spacing $w_{even}=W_{even}/H$. The solid line is $c^{(2)}$, the dashed line is $c^{(4)}$, the dash-dot line is $c^{(6)}$, and the dotted line is $c^{(8)}$. Each even coefficient has one more zero crossing than the previous one, i.e., $c^{(2)}$ has one root, $c^{(4)}$ has two roots, $c^{(6)}$ has three roots, etc. By placing wire pairs 104*a* at the roots of the coefficients, the contribution to the potential from that coefficient can be eliminated.

The number of roots is exactly the number of wires needed to control all of the lower coefficients plus $D^{(1)}$. By placing wire pairs 104*a* at all of the roots of a given even coefficient, and controlling the relative current through each pair, one can tune the lower even coefficients, as well as the additional coefficient $D^{(1)}$. For example, by placing wires 104*a* at the three roots of $c^{(6)}$, there can be independent control of the three parameters $C^{(2)}$, $C^{(4)}$, and $D^{(1)}$, while also having $C^{(6)}=0$.

Figure 4:
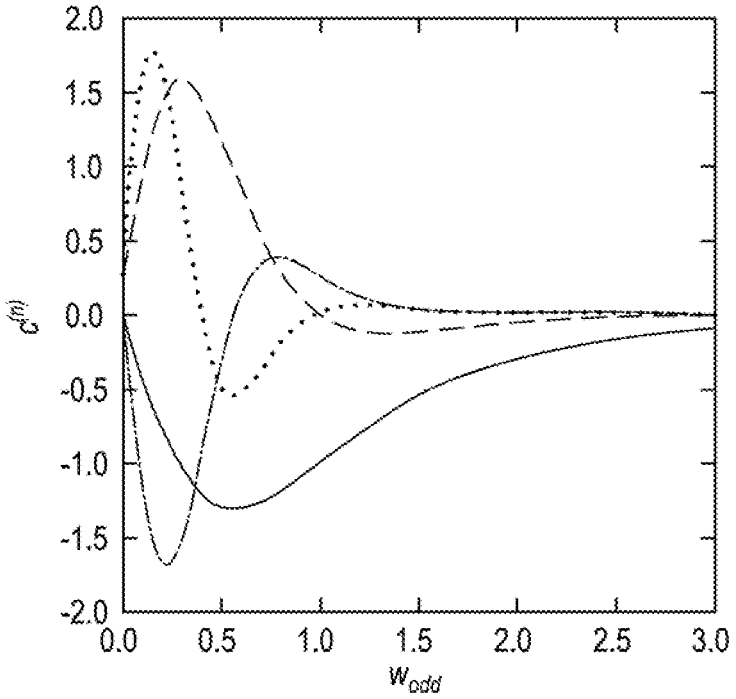
FIG. 4 shows the field of a few odd values of the coefficients $c^{(n)}$ as a function of the wires spacing, $w_{odd}=W_{odd}/H$.

FIG. 4 shows the field of odd values of the coefficients $c^{(n)}$ as a function of the wires spacing $w_{odd}=W_{odd}/H$. The solid line is $c^{(1)}$, the dashed line is $c^{(3)}$, the dash-dot line is $c^{(5)}$, and the dotted line is $c^{(7)}$. Like in the even case, each of the odd coefficients has one more root than the previous one. However, one of the roots is always at $w_{odd}=0$. This root cannot be used to create an odd potential, and is therefore not useful. As a result, $c^{(1)}$ has no useful roots, $c^{(3)}$ has one useful root, $c^{(5)}$ has two useful roots, etc. Like with the even case, by placing the odd wires at the roots of a coefficient, all of the lower coefficients can be controlled. For example, by placing wires at the two roots of $c^{(5)}$, the coefficients $c^{(1)}$ and $C^{(3)}$ can be controlled, and $C^{(5)}=0$. The dominant contribution of the z-component of the field $D^{(0)}$ can be eliminated using a bias field. It is not necessary to have a wire pair 104*a* to control its value.

Now will be presented an example configuration with both low power and optimal control functionality. Once the coefficients are specified for which tunable control is desired, the set of currents {ip(n)} can be found by solving the matrix equations. For the even wires:

$$\begin{pmatrix} c^{(2)}(w_{even,0}) & c^{(2)}(w_{even,1}) & c^{(2)}(w_{even,2}) \\ c^{(4)}(w_{even,0}) & c^{(4)}(w_{even,1}) & c^{(4)}(w_{even,2}) \\ d^{(1)}(w_{even,0}) & d^{(1)}(w_{even,1}) & d^{(1)}(w_{even,2}) \end{pmatrix} \begin{pmatrix} i_{even,0} \\ i_{even,1} \\ i_{even,2} \end{pmatrix} = \begin{pmatrix} C^{(2)} \\ C^{(4)} \\ 0 \end{pmatrix},$$

and for the odd wires:

$$\begin{pmatrix} c^{(1)}(w_{odd,0}) & c^{(1)}(w_{odd,1}) \\ c^{(3)}(w_{odd,0}) & c^{(3)}(w_{odd,1}) \end{pmatrix} \begin{pmatrix} i_{odd,0} \\ i_{odd,1} \end{pmatrix} = \begin{pmatrix} C^{(1)} \\ C^{(3)} \end{pmatrix}.$$

These two equations can be used to set the coefficients $C^{(1)}$ through $C^{(4)}$ for any given wire spacing. However, the contribution to the potential from higher order terms depends on the wire spacing.

The sixth order contribution can be eliminated, $C^{(6)}=0$, by placing the wires 104*a* with spacing of $w_{even,0}=0.228$, $w_{even,1}=0.797$, and $w_{even,2H}=2.076$. The field order contribution is always zero, $C^{(5)}=0$, when $w_{odd,0}=0.577$, and $w_{odd,1}=1.732$. In situations where small sixth order contributions to the potential can be tolerated, the total power consumption of the atom chip can be greatly reduced by moving the outer pair of wires 104*a* closer together. The outer wires 104*a* may be placed at a spacing where $W_{even,2}=W_{even,2L}=1.3$. This choice has much lower power requirements than the optimal spacing and also has a rather low contribution from the sixth order term.

Several examples of trap configurations will now be discussed. A 3-pair even potential with no rotation will be used for exemplary purposes. There will be four free parameters $C_1$ through $C_4$. For each trap type, the results will be presented for the optimal configuration where $w_{even,2}=w_{even,2H}=2.076$, and a low power configuration where $w_{even,2}=w_{even,2L}=1.3$.

For the two wire spacings, the even wire and odd wire equations can be numerically inverted. For the case of the optimal configuration, the currents are given by the relations:

$$\begin{pmatrix} i_{even,0} \\ i_{even,1} \\ i_{even,2H} \end{pmatrix} = \begin{pmatrix} 1.33 & 1.47 & 1.05 \\ 2.31 & 0.70 & 1.64 \\ 12.37 & 11.54 & 5.31 \end{pmatrix} \begin{pmatrix} C^{(2)} \\ C^{(4)} \\ D^{(1)} \end{pmatrix}$$

and for the lower power configuration:

$$\begin{pmatrix} i_{even,0} \\ i_{even,1} \\ i_{even,2L} \end{pmatrix} = \begin{pmatrix} 0.31 & 0.52 & 0.61 \\ 0.29 & -1.18 & 0.77 \\ 3.18 & 2.96 & 1.36 \end{pmatrix} \begin{pmatrix} C^{(2)} \\ C^{(4)} \\ D^{(1)} \end{pmatrix}.$$

With one exception the absolute values in the high power configuration are always larger than the values in the low power configuration. This is especially true of the last row in the matrices, which determines the current in the outer most wire. In the case where $D^{(1)}=0$ the last row in both matrices will not be used in the discussion that follows.

The inverted equation for the odd terms is:

$$\begin{pmatrix} i_{odd,0} \\ i_{odd,1} \end{pmatrix} = \begin{pmatrix} -0.19 & 0.77 \\ -1.73 & -2.31 \end{pmatrix} \begin{pmatrix} C^{(1)} \\ C^{(3)} \end{pmatrix}.$$

Finally, the bias field needed to cancel the $D^{(0)}$ term:

$$B_z^*/B_R=1.66C^{(1)}++1.33C^{(3)}.$$

Harmonic Trap

This tunable trap will be useful for atom interferometry in harmonic traps. This is particularly true for an interferometer that uses trapped thermal atoms because contributions to the fourth (and higher) order term cause decoherence. Fourth order contributions to the potential can be caused by the field length of the wires 104*a* on the chip 100, fields created by the leads connecting the chip 100 to the power supplies, or other by equipment in the laboratory. These contributions can be canceled by tuning the parameter $C^{(4)}$ while holding $C^{(2)}$ constant. To effectively remove the effects of the fourth order contributions to the potential, it must first be determined.

Figure 5:
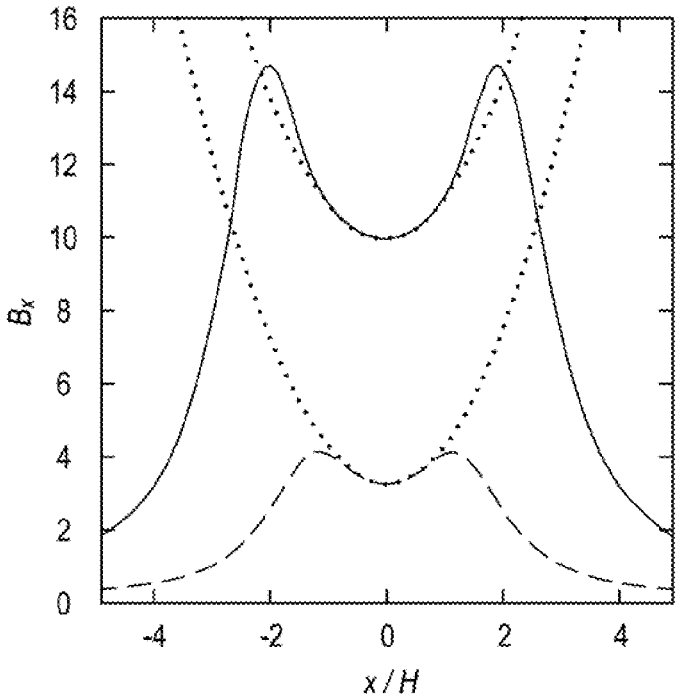
FIG. 5 shows the magnetic field for the case where $C^{(2)}=1$ and all other coefficients are zero.

Before tuning the parameter $C^{(4)}$, a harmonic trap should be created and loaded. FIG. 5 shows the magnetic field for the case where $C^{(2)}=1$ and all other coefficients are zero. The solid curve shows the field produced by the wires 104*a* in the optimal configuration $w_{even,2}=w_{even,2H}$, and the dashed curve shows the field produced by the wires in the low power configuration $w_{even,2}=w_{even,2L}$. The dotted lines are approximation where the uncontrolled higher order terms are neglected. With the pinch wires 104*a* in the optimal configuration, the trap remains harmonic over a larger range. The optimal trap is also deeper and has a larger bottom field. Thus, the bias field to reduce the bottom field will need to be larger for the optimal configuration as compared to the low power configuration.

Figure 6:
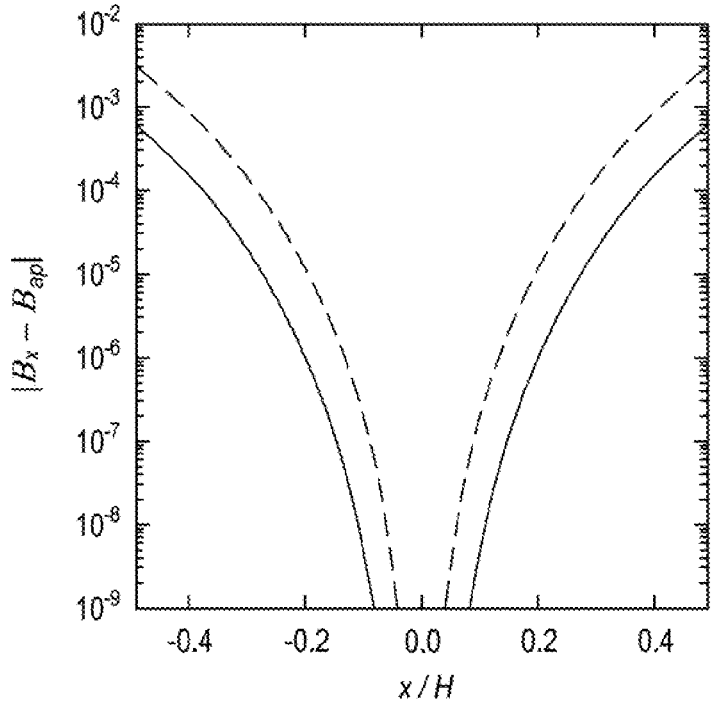
FIG. 6 shows a log plot of the difference between the field with all the contributions to the approximate field that contains only the controlled parameters and the bottom field.

To quantify the effects of the uncontrolled higher order contributions of the field, the difference between the field with all the contributions to the approximate field that contains only the controlled parameters (and the bottom field) was plotted. This is given by $V_{ap}=C^{(0)}+x^2$, where $C^{(0)}$ is found for the two wires spacing's. This difference is plotted as a log plot in FIG. 6. The solid curve shows the difference in the optimal wire configuration and the dashed curve shows the difference in the low power configuration. The low power configuration produces a field that is about an order of magnitude "less harmonic" than the wires in the optimal configuration. However for sufficiently small atomic clouds, $R/H<0.05$, where R is the size of the atomic cloud, both configurations produce potentials that are harmonic to one part in $10^{-9}$. Assuming the resistance of each of the pinch wires 104*a* is equal, the total power dissipated by the pinch wires is given as the sum of the squares of the currents. For the harmonic potential in the optimal configuration, the power dissipation is proportional to $\Sigma_j i_j^2=160.00$ and in the low power configuration the power dissipation is proportional to $\Sigma_j i_j^2=10.27$. For the case of a harmonic potential the power dissipation due to just the pinch wires is 16 times less for the low power configuration. In addition, the required bias field is less, so the total power dissipation will be even less for the low power configuration.

To determine the amount of current that needs to be run in each wire of the chip, the scaling of the current needs to be determined. To make a harmonic trap, with trap frequency ω, the scaling current should be:

$$I_R = \frac{\pi H^3 m\omega^2}{g_F m_f \mu_B \mu_0},$$

where trapping Rb in the F=2, $m_f=2$ state, in a trap with frequency $\omega=2\pi\times10$ Hz that is H=2 mm from the pinch wires, means that $I_R=1.22$ A. Using this scaling current, in the high current configuration means that the currents in the wires must be $I_{even,0}=1.62$ A, $I_{even,1}=2.81$ A, $I_{even,2H}=15.08$ A, and the bottom field is $B_R C^{(0)}=12.20$ Gauss. For the low current configuration the currents are $I_{even,0}=0.37$ A, $I_{even,1}=0.34$ A, $I_{even,2L}=3.87$ A, and the bottom field is $B_R C^{(0)}=4.03$ Gauss.

Double Well Trap

Besides making a tunable single well trap, the chip 100 can be used to produce a double well trap, where both the distance between the two traps and the difference between the potential at the bottom of each trap can be independently tuned. This type of double well trap can be used to study the merging of two cold or ultra-cold atomic clouds, the quantum dynamics of a Bose-Einstein Condensation (BEC) in a double well potential or most interestingly it may be useful as a coherent splitter for a BEC.

Figure 7:
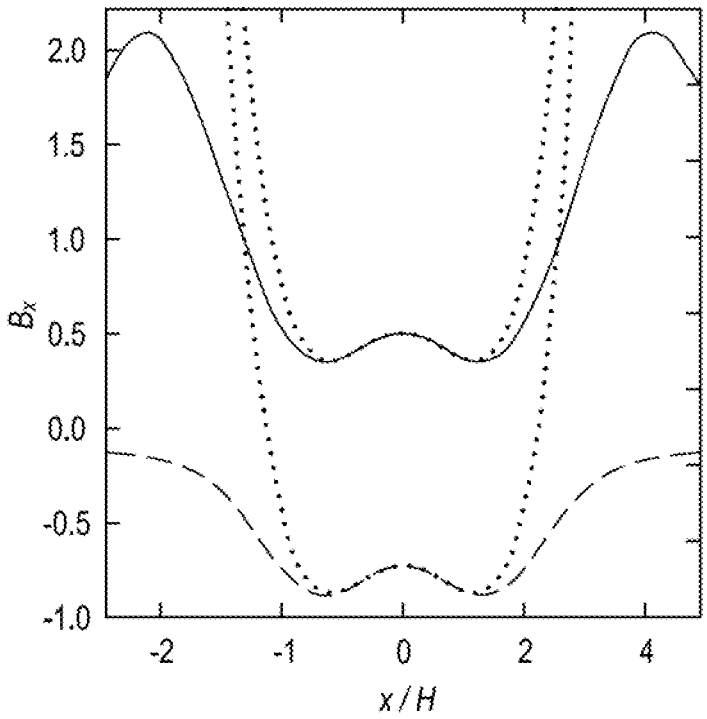
FIG. 7 shows a double well magnetic field produced by chip 100 disclosed herein.

FIG. 7 shows a double well magnetic field produced by chip 100. The solid curve in FIG. 7 shows the magnetic field produced by the pinch wires in the optimal configuration for a double well trap with parameters $C^{(2)}=-0.75$ and $C^{(4)}=1$. The dashed curve is the field produced by the pinch wires 104*a* in the low power configuration. The two dotted curves are the approximate values when no higher order contributions to the field are included. This field is a good example of how two traps that have the same shape near the origin can have very different behavior far from the origin. For the trap created using the wires in the optimal configuration, the bottom field is positive. To reduce the size of this bottom field a negative bias field must be applied. The field has a maximum before it tends towards zero. On the other hand, for the low power configuration, the field is always negative. To create a double well trap at all, there must be a positive bias field applied to lift the field such that it is always positive. The field has no more extrema and tends towards zero after the double well structure.

For this particular choice of parameters $C^{(2)}$ and $C^{(4)}$, the locations of the two wells should be $x/H=\pm\sqrt{3}/8$. FIG. 7 shows that the locations of the wells are slightly larger than this at $x/H\sim\pm0.66$. To create a trap with frequency of 10 Hz, the reference current should be $I_R=0.81$. For the high power configuration the currents should be $I_{even,0}=0.38$ A, $I_{even,1}=-0.82$ A, and $I_{even,2H}=1.83$ A. The magnetic field at the trap minimum is 0.28 Gauss. For the low power configuration, $I_{even,0}=0.23$ A, $I_{even,1}=-1.13$ A, and $I_{even,2L}=0.473$ A. The magnetic field at the trap minimum is −0.71 Gauss.

As discussed, the tunability of an axial magnetic field in a cold atom waveguide 106 can be achieved with sets of paired wires 104*a* on an atom chip 100. A specific implementation of the system and method detailed above for determining the placement of pairs of wires 104*a* and the corresponding operational currents required to make a predetermined polynomial magnetic potential will now be discussed. To review, the number of terms in the polynomial is determined by the total number of wire pairs: 107*a* and 107*b*; 108*a* and 108*b*; 10*a* and 10*b*; 112*a* and 112*b*; and 114*a* and 114*b*. Even and odd wire pairs, spaced by $2W_{p,m}$ as shown in FIG. 2 give control over even and odd contributions to the 1D potential. The location and current in N pairs of parallel wires (107*a* through 114*b*) as shown in the wire configuration of FIG. 2 are such that the resulting magnetic field can be written as a polynomial of order N−1 in an effective one-dimensional (1D) magnetic field. The wires 104*a* are typically placed approximately at the zero crossing of the series expansion of a wire pair. This then substantially cancels that specific higher order contribution. By symmetry, wires with (anti-) parallel currents only contribute to the (odd) even terms in the polynomial expansion of the potential along the guide axis. When a wire pair 104*a* is placed at a zero of a particular coefficient, it allows the lower order terms (of the same parity) to be adjusted without contributing to the coefficient itself. Several wire pairs, appropriately placed, lead to predetermined tunability of several coefficients simply by controlling the relative currents through the sets of wire pairs. The value of the polynomial is then determined by solving a system of linear equations to determine the current for each wire pair (107*a* through 114*b*). These wires 104*a* provide the longitudinal potential. The transverse potential is provided by the magnetic waveguide 106 with an appropriate field such that the added longitudinal waveguide is the dominant contribution. This allows for the creation of a precisely defined magnetic field where the shape is determined by the relative currents in the wires. This has applications in a variety of measurements because extra terms in the polynomial cause loss of the signal at earlier times. By making a purely defined magnetic field these loss terms can be eliminated. The long waveguide 106 that transversely confines the atoms 103 in two-dimensions (2D) may be thought of as marbles rolling in a flexible pipe. The trap in the third (or longitudinal y-axis) dimension is formed by pairs of wires 104*a*. This may be thought of as bending the pipe up at multiple points so the curve of the pipe is controlled at multiple places. Each pair of wires 104*a* can be a trap in and of itself but has extra terms toward the edges that causes imperfections. By adding the magnetic field of several pairs of wires the imperfections of the subsequent lenses can be used to cancel the imperfections of the first lens.

Specifically, in a first step, the magnetic field of each pair of wires 104*a* is written as series polynomial expansion where the magnetic field is broken into its harmonic, quartic, and quantic orders that depend on the relative position of the wires about the origin. As shown in the polynomial equation below, the magnetic field expressed as a sum of the terms:

$$B_x^T(x) = B_x^* + B_R\left[C^{(0)} + C^{(1)}\left(\frac{x}{H}\right) + C^{(2)}\left(\frac{x}{H}\right)^2 + C^{(3)}\left(\frac{x}{H}\right)^3 + C^{(4)}\left(\frac{x}{H}\right)^4 + \ldots\right].$$

In the equation, C0 is the bias, C1 is the linear, C2 is the harmonic, C3 is the cubic, and C4 is the quartic. As previously discussed, FIG. 3 shows the relative strength of each of the C's as a function of the wire spacing. By using multiple wires the relative contributions can substantially cancel. The use of the polynomial equation in the creation of the structure of the chip 100 allows for precision control over the magnetic field which will lead to longer coherence times of atoms 103 in the magnetic trap. Ideally the pairs of the wires 104*a* will be placed at the zeros of one of the orders such that that order is substantially canceled. This is ideal because the quartic term in the polynomial expansion has three zeros and three wire pairs are needed to control the harmonic and quartic terms as seen in FIG. 3. This first step may be optional but makes the solution easier to realize.

In a second step, like terms (e.g., harmonics, quartic) are combined from each expression into a matrix equation.

In a third step, the matrix is inverted in order to determine the current to apply to each wire pair 104*a* in order to control the total magnetic field constitution. For example a trap can be made to have only the harmonic term and set the quartic term to zero. With a different current configuration the harmonic term can be set to zero such that the trap is purely quartic. This has direct applications to precision atom sensors where aberrations in the magnetic trap lead to loss of resolution. This trap can be used to form double well potentials which can be used in the study of fundamental physics. This trap is very versatile because the trapping is only defined by the relative currents in the wires. The wire placement is fixed in the first step of this method and the trap can then be adjusted using the electrical current which does not require significant reconfiguration. Thus multiple traps can be achieved by simply changing the current. This method may have applications in magnetically trapped atomic clocks where ideally the atoms would be confined in a magnetic potential with a very flat magnetic field profile to avoid variations due to a non-uniform field. By going to very high trap orders the trapping field can be controlled to very high precision.

In alternative embodiments, a different magnet trap is called a time-orbiting potential trap (TOP trap). By rapidly moving the magnetic field by rapidly adjusting the currents in the wire pairs the atoms 103 can feel an average force that depends on the motion of the trap. This type of trap can also be used to control the shape of the trap. This trap requires great control over the strength of the fields and coordination between the different parts of the trap.

Experiments that employ 1D potentials now have a tool with which precise potentials may be generated from a single layer of an atom chip.

Atomic physics based devices have application to a wide variety of applications. Devices that could benefit from the precision magnetic potentials are atomic clocks, accelerometers, gyroscopes, magnetometers, gravimeters, and general quantum sensors. For all of these devices the magnetic field must be very carefully controlled to avoid significant degradation of the desired measurement. Additionally, confining the atoms with magnetic fields the size and weight of a sensor can be dramatically reduced compared to devices where the atoms are able to move inside the device and be limited by the size of the vacuum chamber. Therefore, gyroscopes, atomic clocks, accelerometers, magnetometers, gravimeters, and general quantum sensors may include the system and operate by the method disclosed herein.

The foregoing described embodiments have been presented for purposes of illustration and description and are not intended to be exhaustive or limiting in any sense. Alterations and modifications may be made to the embodiments disclosed herein without departing from the spirit and scope of the invention. No language in the specification should be construed as indicating any non-claimed element as essential to the practice of the invention. The actual scope of the invention is to be defined by the claims.

The definitions of the words or elements of the claims shall include not only the combination of elements which are literally set forth, but all equivalent structure, material or acts for performing substantially the same function in substantially the same way to obtain substantially the same result.

All references, including publications, patent applications, patents and website content cited herein are hereby incorporated by reference to the same extent as if each reference were individually and specifically indicated to be incorporated by reference and was set forth in its entirety herein.

The words used in this specification to describe the invention and its various embodiments are to be understood not only in the sense of their commonly defined meanings, but to include by special definition in this specification any structure, material or acts beyond the scope of the commonly defined meanings. Thus if an element can be understood in the context of this specification as including more than one meaning, then its use in a claim must be understood as being generic to all possible meanings supported by the specification and by the word itself.

The terms "a", "an" and "the" mean "one or more" unless expressly specified otherwise. The terms "including", "comprising" and variations thereof mean "including but not limited to" unless expressly specified otherwise. The term "plurality" means "two or more" unless expressly specified otherwise. The phrase "at least one of", when such phrase modifies a plurality of things (such as an enumerated list of things) means any combination of one or more of those things, unless expressly specified otherwise. The use of any and all examples, or exemplary language ("e.g." or "such as") provided herein, is intended merely to better illuminate the invention and does not pose a limitation on the scope of the invention unless otherwise claimed.

Recitation of ranges of values herein are merely intended to serve as a shorthand method of referring individually to each separate value falling within the range, unless otherwise indicated herein, and each separate value is incorporated into the specification as if it were individually recited herein. Therefore, any given numerical range shall include whole and fractions of numbers within the range. For example, the range "1 to 10" shall be interpreted to specifically include whole numbers between 1 and 10 (e.g., 1, 2, 3, . . . 9) and non-whole numbers (e.g., 1.1, 1.2, . . . 1.9).

Neither the Title (set forth at the beginning of the first page of the present application) nor the Abstract (set forth at the end of the present application) is to be taken as limiting in any way as the scope of the disclosed invention(s). The title of the present application and headings of sections provided in the present application are for convenience only, and are not to be taken as limiting the disclosure in any way.

Elements that are described as in "communication" with each other or "coupled" to each other need not be in direct physical contact, unless expressly specified otherwise.

Although process (or method) steps may be described or claimed in a particular sequential order, such processes may be configured to work in different orders. In other words, any sequence or order of steps that may be explicitly described or claimed does not necessarily indicate a requirement that the steps be performed in that order unless specifically indicated. Further, some steps may be performed simultaneously despite being described or implied as occurring non-simultaneously (e.g., because one step is described after the other step) unless specifically indicated. Moreover, the illustration of a process by its depiction in a drawing does not imply that the illustrated process is exclusive of other variations and modifications thereto, does not imply that the illustrated process or any of its steps are necessary to the embodiment(s), and does not imply that the illustrated process is preferred. Where a process is described in an embodiment the process may operate without any user intervention.

The invention claimed is:

1. An atom chip device comprising:

a plurality of wires configured to control a potential in a first direction;

a waveguide configured to control the potential in a second direction; and wherein the plurality wires are spaced a predetermined spacing distance apart from each other so that by adjusting currents in the plurality of wires the potential in the first and second directions can be tuned to produce a double well trap.

2. The device of claim 1, wherein:

the plurality of wires are arranged in wire pairs; and the current can be independently adjusted for each of the wire pairs.

3. The device of claim 2, wherein:

the potential in the first direction is defined by a magnetic field comprised of harmonic, quartic and higher orders, and the magnetic field is changeable by adjusting the current in each of the wire pairs.

4. The device of claim 2, further comprising:

a polynomial model which calculates the potential and breaks the potential into harmonic, quartic, and higher orders that depend on the number and relative spacing of the wire pairs about an origin;

the potential being comprised of a contribution from each of the orders; and a portion of the contribution from each of the orders is substantially cancelled.

5. The device of claim 4, wherein the current to supply to each wire pair is calculated based on inverting a matrix constructed from the harmonic, quartic, and higher orders of the polynomial model.

6. The device of claim 1, wherein the plurality of wires lie substantially in a common plane.

7. The device of claim 6, wherein the waveguide lies substantially in a waveguide plane which is parallel to and spaced apart from the common plane.

8. The device of claim 1, further configured to create a time orbit potential trap by rapidly adjusting the currents in the plurality of wires.

9. The device of claim 1, wherein:

the double well trap is comprised of two traps separated by a trap distance, with each of the two traps having a bottom and a bottom potential at the bottom;

a difference between the two bottom potentials; and both the trap distance and the difference between the bottom potentials can be independently tuned.

10. A method of controlling atoms using an atom chip comprising:

adjusting currents in a plurality of wire pairs which i) lie substantially in a common plane oriented normal to a waveguide plane including a waveguide; and ii) are spaced a predetermined spacing distance apart according to a polynomial model so as to tune a magnitude and a direction of a potential to produce a double well trap.

11. The method of claim 10, wherein:

the plurality of wires are arranged in wire pairs; and the currents can be independently adjusted for each of the wire pairs.

12. The method of claim 11, wherein the polynomial model which calculates the potential is broken into its harmonic, quartic, and higher orders that depend on spacing of the wire pairs about an origin.

13. The method of claim 12, wherein:

the potential is comprised of a contribution from each of the orders, and further comprising:

spacing the plurality of wire pairs about the origin so that a portion of the contribution from each of the harmonic, quartic, and higher orders is substantially cancelled.

14. The method of claim 13, wherein the current to supply to each wire pair is calculated based on inverting a matrix constructed from the harmonic, quartic, and higher orders of the polynomial model.

15. The method of claim 10, wherein the plurality of wires are arranged in wire pairs to provide control over even and odd contributions to the polynomial model.

16. The device of claim 10, wherein:

the double well trap is comprised of two traps separated by a trap distance, with each of the two traps having a bottom and a bottom potential at the bottom; and both the trap distance and a difference between the bottom potentials can be independently tuned.

17. An apparatus for creating a magnetic potential having a variable shape, comprising:

a plurality of wires arranged as a plurality of wire pairs configured to control the magnetic potential in a first direction;

a waveguide positioned to control the magnetic potential in a second direction;

each of the wire pairs being comprised of two members lying in parallel;

each of the members being for conducting electric current; and the electric current for each set of the wire pairs being equal for each of the two members, being independent of the electric current for the other wire pairs, and being independently adjustable, whereby the shape of the magnetic potential in the first direction is controlled by adjusting the respective electric currents in the wire pairs.

18. The apparatus as defined in claim 17 wherein:

the plurality of wires are parallel to one another and lie substantially in a common plane, and the waveguide lying in a waveguide plane, which lies parallel to and spaced apart from the common plane.

19. The apparatus as defined in claim 17 wherein:

the two members of each of the wire pairs are spaced apart from each other by a spacing distance; and the shape of the magnetic potential in the first direction is further controlled by adjusting the spacing distance.

20. The apparatus as defined in claim 17 wherein:

the wire pairs are comprised of odd wire pairs and even wire pairs; and the members of each of the odd wire pairs being for having the current flowing in a first direction and the members of each of the even wire pairs being for having the current flowing in opposite directions.

* * * * *